United States Patent [19]

Grutza et al.

[11] 3,965,623

[45] June 29, 1976

[54] METHOD FOR TRUEING COMMUTATORS AND SLIP RINGS

[76] Inventors: Thaddeus Robert Grutza, 2160 Stirling Road c/o Deerfield P.O., Bannockburn, Ill. 60015; Kenneth Edward Grutza, 3246 Robincrest Drive, Northbrook, Ill. 60062

[22] Filed: July 7, 1975

[21] Appl. No.: 593,590

Related U.S. Application Data

[63] Continuation-in-part of Ser. No. 533,121, Dec. 16, 1974, abandoned.

[52] U.S. Cl. ..... 51/281 R; 51/244; 51/289 R

[51] Int. Cl.[2] ..... B24B 1/00; B24B 5/50

[58] Field of Search ..... 51/241 R, 241 S, 244, 51/254, 281 R, 289 R, 34 E, 103 C

[56] References Cited

UNITED STATES PATENTS

| | | | |
|---|---|---|---|
| 969,633 | 9/1910 | Jordan | 51/244 |
| 1,072,410 | 9/1913 | Chappell | 51/244 |
| 1,446,982 | 2/1923 | Mauran | 51/244 |
| 1,633,885 | 6/1927 | Castillo | 51/244 X |

OTHER PUBLICATIONS

Westinghouse Maintenance Bulletin, Esdl No. 50–27, supp. 2.

*Primary Examiner*—Al Lawrence Smith
*Assistant Examiner*—Nicholas P. Godici
*Attorney, Agent, or Firm*—Hill, Gross, Simpson, Van Santen, Steadman, Chiara & Simpson

[57] ABSTRACT

Trueing of commutators and slip rings of large industrial motors, generators, convertors and the like without dragover of copper into insulating spaces between commutator segments or loading of surface of the trueing tool is afforded by employing an ultra-high speed grinding wheel mounted on the shaft of a precision portable electric motor mounted for traversing across the width of the contact surface. A grinding wheel in a grit range of 150 to 180 is operated at a peripheral surface speed at the grinding point of at least 7,000 feet per minute (2100 meters per minute). This speed corresponds to a 4,500 rpm rotational speed for a 6-inch. (0.1524 meter) diameter wheel. The motor and wheel are of a size and weight enabling manual mounting on a traversing compound adjacent the surface to be ground.

3 Claims, 3 Drawing Figures

METHOD FOR TRUEING COMMUTATORS AND SLIP RINGS

This is a continuation-in-part of application Ser. No. 533,121, filed Dec. 16, 1974, now abandoned.

BACKGROUND OF THE INVENTION

1. Field of the Invention

This invention relates to an improved method and apparatus for maintaining and dressing commutators and slip rings of large industrial motors, generators, convertors and similar machinery, with or without removal of the armature from the machine.

2. Description of the Prior Art

It is known in the art to traverse either a fixed grinding stone or a grinding wheel across the face of a commutator or slip ring of an armature while the armature remains in its normal bearings and spins in the bearings while the surface is dressed. Several patents have employed grinding wheels driven by belts from remote motors, such as Chappell U.S. Pat. No. 1,072,410 and Mauran U.S. Pat. No. 1,446,982. Chappell described his main shaft as rotating at a "very high speed" of between 1,800 and 2,500 rpm.

Also representative of the prior art is a Westinghouse Maintenance Bulletin, ESDL No. 50–27, Supp. 2 which recommends trueing tool steel collector rings with a precision rotating grinder mounted on a lathe carriage, using an 80 or 120 grit wheel spinning to produce a 3,500 to 4,500 feet per minute (1050 to 1400 meters per minute) surface speed. This Bulletin specifies that only one-fourth inch of the wheel width should be in contact with the collector ring during grinding. For larger, higher-speed collector rings on turbine generators, rotational speeds of 3,900 to 5,650 feet (1,200 to 1,700 meters) per minute and use of 1-inch (2.54 cm) thick wheels of 80 to 120 grit are recommended. The Westinghouse Bulletin cautions that the spiral groove in the ring should be rechamfered after grinding to remove burrs caused by the wheel dragging the ring material over or into the groove.

SUMMARY OF THE INVENTION

The present invention comprises the concept of trueing commutators and slip rings of large industrial rotating machines using a portable relatively high speed, 3-phase motor, for example, as exemplified by a 2-pole induction motor with precise tolerances in the bearings of the motor shaft to drive directly a grinding wheel at an "ultra-" high surface speed. The grinding wheel on the motor shaft is traversed across the face of the spinning commutator or slip ring on a compound mount. Use of a 6 inch 150 to 180 grit grinding wheel, for example, safely operable at least at 4,500 rpm produces a surface speed of at least 7,000 feet (2,100 meters) per minute. This ultra high surface speed, in comparison to the 3,500 to 5,600 feet (1,050 to 1,700 meters) per minute of the prior art, has been discovered to avoid the dragging of copper into insulation spaces between the copper segments of a commutator, as experienced in the prior art. Only very low pressures need be applied between the grinding wheel and the commutator or slip ring to be ground.

It is also an important concept of the present invention that the motor be sufficiently small in diameter, length, and weight, and have easily-transportable support and control devices, to be portable by hand and to have a grinding wheel mounted directly on its shaft engageable with the surface of the commutator or slip ring. It is also possible and desirable with the present invention to employ a wheel of a fairly fine grit, as from 150 to 180 grit size, to increase the wearing time of the wheel and to reduce scratching of the surface being dressed.

The procedures contemplated can be practiced either in-place with large equipment or with the electrical contact surface in a lathe if removal of the armature of the device to be treated is feasible.

DESCRIPTION OF THE PREFERRED EMBODIMENTS

Figure 1:
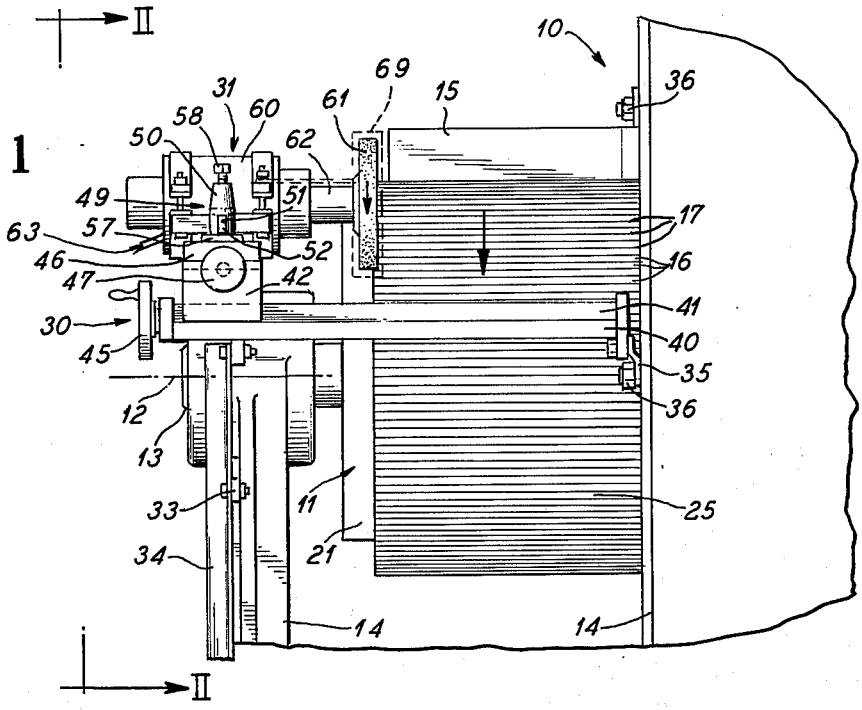
FIG. 1 is a general elevational view from the side of a rotating electrical device with some of the brushes and housing structure removed from about the commutator and the traversing compound and grinding wheel assembly in operating position.

Referring to the drawings, a large industrial rotating electrical device is shown generally at 10; this device is shown in the form of a rotary convertor but may be any sort of motor or generator or the like which has a rotating armature 11 spinning about an axis 12 in bearings 13 which are mounted firmly in a housing and supporting framework 14. The armature is normally engaged by a plurality of brushes mounted in holders 15.

The armature 11 is shown as having a commutator in the drawings, having copper segments 16 each separated by recessed mica segments 17; the armature 11 may also have a slip or collector ring having spiral grooves in the contact surface for various purposes.

Figure 3:
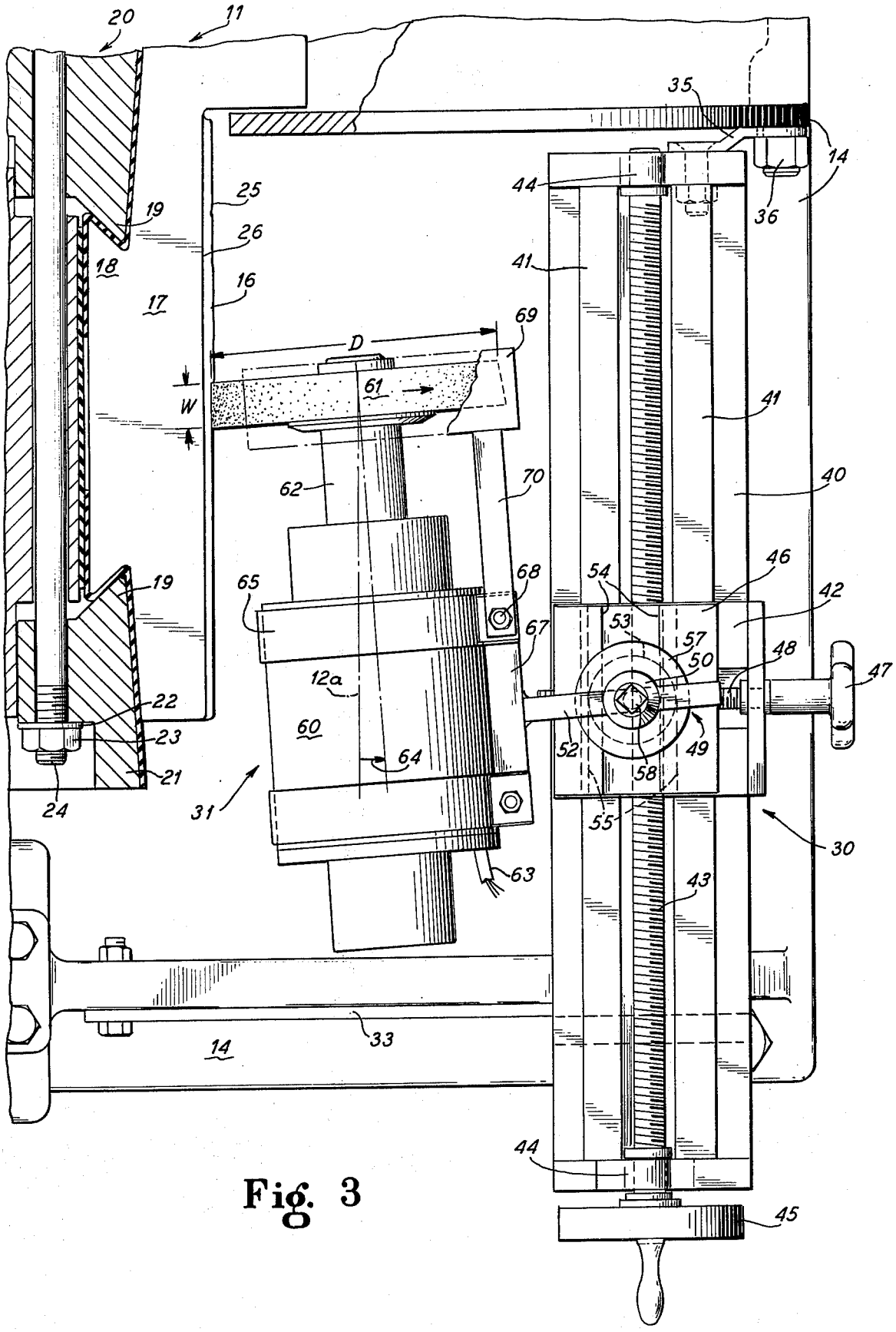
FIG. 3 is a broken elevational view taken generally along the line III—III of FIG. 2 but modified by canting the motor axis slightly with respect to the commutator axis in accordance with the principles of the present invention and showing the grinding wheel midway through its traverse of the width of the commutator, showing removal of copper from the commutator segment without dragging copper over the mica insulation.

As shown in FIG. 3, the commutator is formed by a plurality of copper segments 16 and mica segments 17 each having a partially V -shaped foot area 18, which is captured by ears 19, 19 of the armature core 20, which core 20 includes a movable gripping part 21 secured and adjusted to the core 20 by means of a bearing washer 22 clamped by a threaded nut 23 on a threaded shaft 24. During assembly of the electrical device 10 and the armature 11, each of the copper segments 16 and the mica insulating segments 17 are engaged by the ears 19, 19 of the armature core 20 so that exposed surfaces 25 of the copper segments 16 are spaced above exposed surfaces 26 of the mica segments 17, all of the copper surfaces 25 being at generally the same radius from the axis of rotation 12 of the armature 11.

Figure 2:
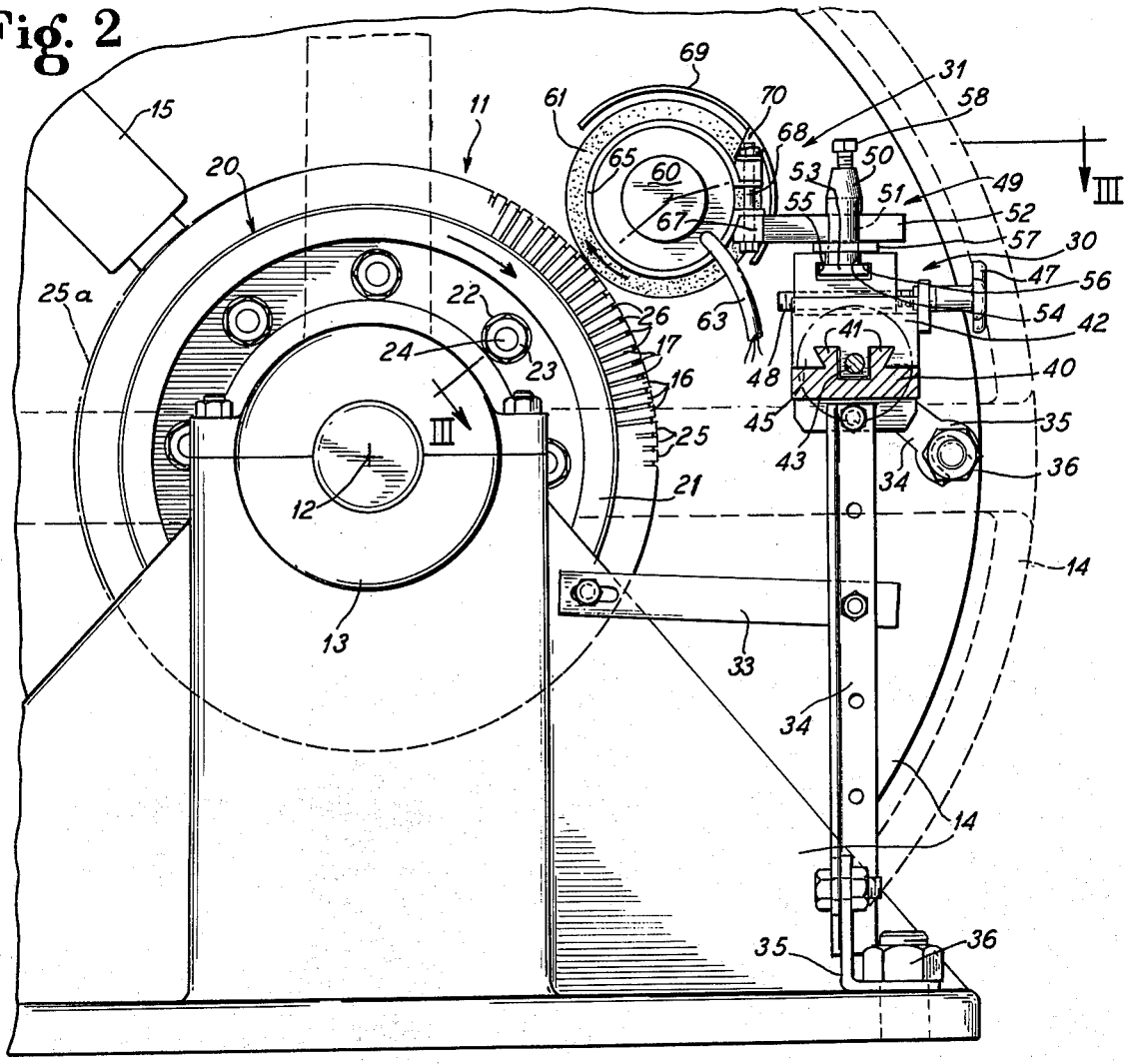
FIG. 2 is a plan view on lines II—II of FIG. 1 of the end of the rotating electrical device on which the traversing compound and grinding wheel assembly in operating position.

However, during normal operation, the copper segments 16 may shift and adjust in response to centrifugal, electrical, and temperature loads thereon, and electrical burning or abrasion or other defects may result in the contact surfaces 25 being at different radii from the axis of rotation 12 of the armature 11. A typical out-of-round condition is shown at 25a in FIG. 2. Whenever relative high spots and low spots about the contact surface 25 occur, causing increased wear to the brushes of the device and decreased efficiency thereof, treatment is required. The chief object of the apparatus and method of this invention is to return the electrical contact surface 25 to a true circular and generally cylindrical configuration with respect to the axis of rotation 12 of the armature 11, while the armature 11 rotates in its own bearings 13.

In accordance with the principles of the present invention, in order to treat or dress the electrical contact surface 25, a portion of the housing 14 and a number of the brush holders 15 must be removed from about the armature 11 to give access to the surface of the armature 11 by a traversing compound shown generally at 30 and its associated grinding apparatus 31.

To provide a rigid mount by which the grinding apparatus 31 may be placed and moved in contact with the electrical contact surface 25, a compound mount 30 is affixed to structural parts of the housing 14 of the device 10 by any convenient means. Shown in the drawings are a series of slotted and perforated steel bars and angles 33, 34, including horseshoe-shaped washers 35 with upturned attachment means, the washer portion engaging existing bolts and nuts 36 forming part of the structure of the device 10, which may be conveniently loosened and then tightened after a washer 35 has been inserted thereunder.

It is also often possible and convenient to clamp or bolt the compound directly to a brush holder 15 left installed adjacent the access area through the housing 14. The traversing compound 30 is of a general type widely employed in the commutator dressing art, employing a rigid bed 40 having rails 41, 41 which guide a longitudinally movable member 42 therealong. The member 42 is selectively adjusted by a screw-threaded shaft 43 which runs the length of the bed 40 between the rails 41, 41 and is journaled for rotation at the ends 44, 44 of the bed 40. The shaft 43 is rotated by means of a manual crank 45 located at a free end of the bed 40. Carried by the member 42 of the traversing compound is a transversely moveable member or car 46 movable transversely to the compound bed 40 under control of a second manually rotatable handle 47 connected to a threaded shaft 48 journaled in the movable member 42.

The transversely moveable member or car 46 carries a clamping assembly 49 which is rotatable about a vertical axis. The clamping assembly 49 comprises a generally cylindrical vertical member 50 which is slotted as at 51 to receive a metal bar 52 in slidably adjustable relationship therebetween. The lower portion of the member 50 forms an enlarged circular foot 53. The member 50 is slidably received within a longitudinal slot 54 in the car 46, the foot 53 of the vertical body 50 being received within the car in an enlarged slot 55 having an upper shoulder surface 56. A washer member 57 is received about the vertical member 50 and beneath the slot 51 and metal bar 52.

An upper portion of the vertical member 50 engages a threaded adjustment bolt 58 which passes into the slot area 51 to bear against an upper surface of the metal bar 52, thereby to apply selectively a clamping force between the foot 53 of the vertical member 50 and the thrust washer 57 which is captured beneath the metal bar 52. When the bolt 58 is loose the clamping assembly 49 is free to be moved longitudinally in the slot 54 and to be rotated about a vertical axis within the slot, and the metal bar 52 may be adjusted along its own length within the slot 51. Thus a universal adjustment is afforded between the grinding assembly 31 and the car 46, which upon tightening of the bolt 58 may be fixed for the grinding operation, as described below.

In accordance with the principles of the present invention, the grinding assembly principally comprises a high speed precision motor 60. A grinding wheel 61 is mounted on shaft 62 of the motor 60, the wheel 61 being safely operable at ultra-high surface speeds at its periphery. The motor found most suitable for use in the method of the present invention is a three phase, two pole induction motor having precise tolerances in its shaft bearings, operable with one cycle per volt and providing sixty revolutions per minute per volt or cycle within its operating envelope of up to 9,000 rpm, with substantial output torque. The only auxilliary equipment required with such a variable speed AC motor is an AC control box (not shown) which varies the frequency and voltage supply to the motor 60 via a power cord 63.

The grinding wheel 61 should be of a selected width W and diameter D (FIG. 3) and it has been found that a ½ to ¾ inch (1.27 to 1.9 cm) wheel with a six inch (15 cm) diameter is most generally suitable. It has been found that a fairly fine grit, as from 150 to 180 grit size, increases the wearing time of the wheel at high speeds, produces less scratching of the electrical surface 25, and removes material at an acceptably high rate.

As shown in FIG. 3, it is preferable to cant the axis of the motor 60 and grinding wheel 61 at an angle 64 to line 12*a* parallel to the axis of rotation 12 of the armature 11. This canting of the motor, by rotational adjustment of the clamping means 49 on the car 46 of the compound 30 increases the effective life of the grinding wheel 61 by allowing its diameter to decrease more before the housing 65 of the motor 60 would engage the electrical contact surface 25. The grinding wheel 61 will wear to conform to the angle 64 at its contact point with the contact surface 25 of the armature 11.

The grinding assembly 31 is held rigidly with respect to the traversing compound 30 and the armature 11 by means of the bar 52 which is engaged by the clamp assembly 49 of the car 46. The bar 52 is welded to a second bar 67 perpendicular thereto, which bar is firmly mounted to the motor 60 by straps, which form part of the housing 65 of the motor, and bolts 68 passing through the straps 65 and the bar 67. In accordance with the Federal safety regulations, a grinding wheel guard or shield 69 may be attached to one of the bolts 68 by means of a bar 70; the guard 69 should be of sufficiently small width to avoid interfering with full traversal of the grinding assembly 31 across the width of the electrical contact surface 25.

The concept of the present invention may also be employed in applications, as in maintaining traction motors of railway locomotives, where trueing a commutator can only be accomplished by removing the armature from its own bearings to a lathe bed, due to physical space limitations in the normal environment of the motor. Also, some motors and generators are of relatively small size and are conveniently removed from their housings for trueing of their electrical contact surfaces upon a lathe bed. The contact surfaces may in such cases be trued by a grinding wheel carried by a traversing compound on the tool rest of the lathe bed in the same manner as in-place trueing is carried out otherwise in accordance with the principles of the present invention.

In operation, the device 10 is readied for dressing of the electrical contact surface 25 by removing parts 14a of the housing 14 and some of the brush holders 15 to afford access for the traversing compound 30 and grinding assembly 31 to a segment of said surface 25. The traversing compound 30 may be mounted to the housing 14 of the device 10 with steel bars and angles and horseshoe washers as shown, or the compound 30 may be clamped to a convenient brush holder 15 adjacent the access sector. The compound 30 must be secured at each end in vertical and horizontal planes and be secured against rotation about its longitudinal axis. This mounting should be firm but need not be able to withstand great pressures, since the improved method requires remarkably little force to be exerted between the grinding wheel 61 and the electrical contact surface 25 to dress and true the surface 25 as required, the force estimated to be in the range of from about 2 to 3 pounds or less. The compound bed 40 should be horizontal and as closely parallel as possible to the axis 12 of the armature 11, although so long as the surface 25 is trued accurately circular at all points some minor conicality or other deviation from a true cylindrical shape across the width of the surface 25 from misalignment of the bed 40 will not affect brush wear or electrical performance of the rotating device 10.

Once the traversing compound 30 is in place, the grinding assembly 31 may be engaged via the bar 52 affixed to the motor 60 with the clamping mechanism 49 of the car 46. The bar 52 may be slid along its length within the slot 51 in the clamp 49 and the clamp 49 may be rotated about its vertical axis to increase or decrease the angle 64 between the motor axis and the line 12*a* parallel to the armature axis 12, in the horizontal plane. Between these two gross adjustments, the grinding wheel 61 on the motor shaft 62 may be brought approximately into a position to engage the electrical contact surface 25. Then the bolt 58 is tightened, clamping the bar 52 to fix the position of the grinding wheel 61 relative to the longitudinal axis of the bed 40 of the traversing compound 30. Then the guard 69 is mounted on the grinder assembly 31 and the grinding wheel 60 brought into immediate proximity to the electrical contact surface 25 by means of a fine adjustment in the transverse direction by rotation of the handle 47.

The armature 11 is then spun to any desired speed, which may be the operating speed of the device 10 during normal operation, or any lesser speed which may be obtained through auxilliary turning means with some or all of the brushes 15 removed. The armature 11 may alternatively brought to a speed and then the energization removed, allowing the armature 11 to coast with gradually decreasing rotational speed; or in the case of a DC motor operated at a reduced voltage sufficient to produce an adequate rotational speed.

The grinding assembly 31 is then switched on and the speed of the motor shaft 62 adjusted so that the peripheral speed of the grinding wheel 61 is substantially at least 7,000 feet (2100 meters) per minute. The speed may be adjusted during operation as the grinding wheel wears, or a higher initial speed may be selected, up to the safe rating of the grinding wheel. Generally, lesser wheel speeds result in higher wear rates of the wheel and more dragging of copper on a commutator into insulating spaces between the copper bars 16. Above 7,000 feet (2100 meters) per minute, wheel wear and dragging of copper are minimal. While it has been determined that higher peripheral speeds decrease wheel wear rates, there is a commensurate increase in the speed of treatment or dressing of the contact surface 25.

With both the armature 11 and the grinding wheel 61 spinning, the longitudinal and transverse adjustment wheels 45 and 47 may be operated to bring the grinding wheel 61 into contact with the highest radial points of electrical contact surface 25. Depending on the condition of the contact surface 25, light or heavy cuts may be taken by the grinding wheel 61. It will be found that material may be removed more quickly at the ultra-high grinding wheel speed than as practiced in the prior art, allowing faster dressing of the contact surface 25. Where the surface 25 is appreciably out-of-round, as shown at 25*a*, the operator must be careful in feeding the grinding wheel 61 into engagement with the surface 25 that he avoids vibrations caused by the high part 25*a* contacting the grinding assembly 31 at a natural oscillation frequency of the wheel 61 or the mount of the compound 30.

The grinding assembly 31 is traversed across the width of the contact surface 25, taking only as much material from the copper segments 16 as may be necessary to restore an adequate degree of circularity to all points of the surface 25 and to obtain a generally cylindrical shape for the entire surface 25. In accordance with the features of this invention, the insulating slots between the copper segments 16 remain clean since the ultra-high-speed grinding removes the copper as dust rather than merely dragging the copper circumferentially across the surface 25. If much material is removed, as where the surface 25 is greatly out-of-round, some or all of the mica segments 17 must be reduced in radial size to avoid damage to brushes as a final operation.

Finish grinding and polishing may be accomplished with the apparatus of the present invention, using a polishing-grade wheel, although it is generally found that a hand-held polishing stone will accomplish the polishing task more quickly and with just as adequate results.

Although various modifications might be suggested by those versed in the art, it should be understood that we wish to embody within the scope of the patent warranted hereon all such modifications as reasonably and properly come within the scope of our contribution to the art.

We claim as our invention:

1. The method of in-place trueing of a segmented copper commutator with a traversing grinding wheel which includes the improved steps of:

1. rotatably driving the commutator to be trued in its own journal support so that the commutator surface is in its normal running position;
2. simultaneously rotatably driving a peripheral grinding wheel surface exhibiting a grit size in the order of from about 150 to 180 at a peripheral speed of substantially at least 7,000 feet per minute;
3. contacting at least ½ to ¾ inch of said peripheral surface against the commutator surface with forces in the order of from about 2 to 3 pounds; and
4. maintaining the relative surface speed of the commutator and the grinding wheel surface at ultra high speeds in excess of 7,000 feet per minute, thereby to remove the copper commutator material in the form of dust without drag over between the segments.

2. The method of in-place trueing as defined in claim 1, and canting the wheel at an angle relative to the axis of the spinning surface so that the minimum usable radius of the wheel can be decreased.

3. The method of trueing a segmented copper commutator with a traversing grinding wheel which includes the improved steps of:

1. rotatably driving a peripheral grinding wheel surface exhibiting a grit size in the order of from about 150 to 180 at a peripheral speed of substantially at least 7,000 feet per minute;
2. contacting at least ½ to ¾ inch of said peripheral surface against the commutator surface with forces in the order of from about 2 to 3 pounds; and
3. maintaining the relative surface speed of the commutator and the grinding wheel surface at ultra high speeds in excess of 7,000 feet per minute, thereby to remove the copper commutator material in the form of dust without drag-over between the segments.

* * * * *